US008925629B2

(12) United States Patent
Vestavik et al.

(10) Patent No.: US 8,925,629 B2
(45) Date of Patent: Jan. 6, 2015

(54) DOWN HOLE WELL TOOL WITH EXPANSION TOOL

(75) Inventors: Ola Vestavik, Eggesbones (NO); Harald Syse, Royneberg (NO)

(73) Assignee: Reelwell AS (NO)

( * ) Notice: Subject to any disclaimer, the term of this patent is extended or adjusted under 35 U.S.C. 154(b) by 573 days.

(21) Appl. No.: 13/382,124

(22) PCT Filed: Jun. 30, 2010

(86) PCT No.: PCT/NO2010/000251

§ 371 (c)(1),
(2), (4) Date: Jan. 4, 2012

(87) PCT Pub. No.: WO2011/005104

PCT Pub. Date: Jan. 13, 2011

(65) Prior Publication Data

US 2012/0090855 A1 Apr. 19, 2012

(30) Foreign Application Priority Data

Jul. 6, 2009 (NO) ..... 20092543

(51) Int. Cl.
*E21B 43/10* (2006.01)

(52) U.S. Cl.
CPC ..... *E21B 43/105* (2013.01)
USPC ..... 166/207; 166/384

(58) Field of Classification Search
CPC ..... E21B 43/103; E21B 43/105; E21B 29/10; E21B 23/01; B21D 39/10; B21D 39/20
USPC ..... 166/207, 382, 380, 277, 384, 212, 153; 29/523
See application file for complete search history.

(56) References Cited

U.S. PATENT DOCUMENTS

| | | | | |
|---|---|---|---|---|
| 1,561,418 | A * | 11/1925 | Duda | 72/119 |
| 1,569,729 | A * | 1/1926 | Duda | 72/45 |
| 3,818,734 | A * | 6/1974 | Bateman | 72/75 |
| 6,029,748 | A * | 2/2000 | Forsyth et al. | 166/380 |
| 6,457,532 | B1 * | 10/2002 | Simpson | 166/380 |
| 6,543,552 | B1 * | 4/2003 | Metcalfe et al. | 175/57 |
| 6,860,329 | B1 * | 3/2005 | Oosterling | 166/298 |
| 7,048,067 | B1 * | 5/2006 | Cook et al. | 166/380 |
| 7,104,322 | B2 * | 9/2006 | Whanger et al. | 166/277 |
| 7,124,823 | B2 * | 10/2006 | Oosterling | 166/298 |
| 7,350,585 | B2 * | 4/2008 | Simpson et al. | 166/380 |
| 7,497,255 | B2 * | 3/2009 | Filippov et al. | 166/207 |
| 7,640,976 | B2 * | 1/2010 | Filippov | 166/212 |
| 7,730,955 | B2 * | 6/2010 | Farquhar et al. | 166/380 |
| 8,020,625 | B2 * | 9/2011 | Ring et al. | 166/380 |
| 8,028,749 | B2 * | 10/2011 | McHardy et al. | 166/207 |
| 8,549,906 | B2 * | 10/2013 | Green et al. | 73/152.57 |
| 2003/0183395 | A1 | 10/2003 | Jones | |

(Continued)

*Primary Examiner* — Daniel P Stephenson
(74) *Attorney, Agent, or Firm* — Adenike Adebiyi

(57) ABSTRACT

A down hole well tool (3) for installing a casing/liner (1) in a well bore (2), wherein the down hole well tool comprises a tool unit comprising at least one first fluid conduit (6) and a return fluid conduit (5) in use forming an annulus between the tool unit and the casing/liner. The tool unit further comprises at least one piston (7*a*, 7*b*) in the annulus dividing the annulus into annulus spaces (8*a*, 8*b*, 8*c*). At least two expansion modules (9*a*, 9*b*) for the expansion of the casing are positioned displaced in the axial direction of the casing. The expansion modules are arranged to be moved relative to each other in the axial direction of the casing.

18 Claims, 2 Drawing Sheets

(56) References Cited

U.S. PATENT DOCUMENTS

| | | | | |
|---|---|---|---|---|
| 2003/0230410 | A1 | 12/2003 | Underhill | |
| 2004/0149442 | A1 * | 8/2004 | Mackenzie | 166/297 |
| 2005/0161226 | A1 * | 7/2005 | Duggan et al. | 166/380 |
| 2006/0070742 | A1 | 4/2006 | Sivley, IV | |
| 2007/0119597 | A1 | 5/2007 | McHardy et al. | |
| 2007/0169943 | A1 | 7/2007 | Vestavik | |
| 2012/0090855 | A1 * | 4/2012 | Vestavik et al. | 166/382 |
| 2012/0103592 | A1 * | 5/2012 | Alhaug | 166/153 |
| 2012/0103596 | A1 * | 5/2012 | Vestavik et al. | 166/207 |

* cited by examiner

DOWN HOLE WELL TOOL WITH EXPANSION TOOL

BACKGROUND

1. Field of the Invention

The invention relates to a down hole tool for installing a casing or liner in a well bore.

2. Related Art

U.S. Patent Application No. 2007/0169943 ("Vestavik") discloses a method for setting a casing in a borehole using a running tool including a drilling tool, an expandable casing, an expansion tool, and a packer arranged to seal against the wall of the borehole.

SUMMARY

The invention concerns a down hole well tool for installing a casing or a liner in a well bore. The down hole well tool comprises a tool unit comprising at least one first fluid conduit and a return fluid conduit in use forming a well annulus between the tool unit and a well bore, and at least one piston dividing the well annulus into well annulus spaces.

The return fluid conduit may be arranged in the first fluid conduit, leaving an annular space in between the first fluid conduit for the flow of a first fluid, wherein the return fluid may be arranged to pass in the centrally arranged space of the return fluid conduit.

The tool unit in accordance with the invention is operated by the differential fluid pressure brought about over the piston(s) of the tool unit. Due to the characteristics of the fluid provided at either side of the piston. In the case where the tool unit includes one piston, this piston isolates the well annulus into two separate well annulus spaces. In other cases two or more pistons are included in the tool unit, thereby dividing the well annulus into a correspondingly number of well annulus spaces. By the introduction of pressurized fluid into one of the well annulus spaces the following differential fluid pressure occurring over the piston may be used for displacing the whole tool unit in the well bore or for displacing the piston relative the tool unit. The piston may be provided with means for communication of fluid from one well annulus space at one side of the piston through the piston and to the other well annulus space at the other side of the piston. This may be useful in many ways, such as when setting and the retrieving the down hole well tool and when using the tool for the expansion of a casing/liner. The communication of fluid between the adjacent well annulus spaces may be controlled in various ways; by the differential fluid pressure over the piston, by electrical, mechanical or hydraulic signals, or by the relative movement between the first fluid conduit and a control element.

The piston may be provided solely as a sealing element or may be made up by different portions having sealing characteristics and rigid characteristics for providing strength and conducting necessary operations such as expansion. Further the piston may be provided in one piece or made up by two or more elements. The piston may be operated inside a casing/liner or it may be operated in a well bore hole which has not been cased. The piston may be provided to be moved relative the tool unit in an axial direction of the well bore or may be arranged to be moved with the tool unit in an axial direction relative to the well bore.

To obtain the necessary expansion of the casing/liner in the well bore a system capable of supplying high forces to is required to be able to deform the casing/liner to be set in the well bore. The forces required for expansion may in some case reach a level wherein the forces may harm the system itself.

Based on this a need has evoked to produce a solution wherein the forces necessary to carry out casing/liner expansion may be reduced.

In accordance with the inventive down hole well tool, using separate expansion modules, at least two expansion modules, for the expansion of the casing/liner reduces the need for high forces to acquire the necessary expansion. By using at least two expansion modules, the expansion to be carried out is distributed among the expansion modules, and thus the force necessary to cause the deformation of each expansion module is reduced correspondingly, thereby avoiding exposing the system to high level forces.

To achieve the expansion of the casing/liner in accordance with the invention the expansion modules are positioned displaced in the axial direction of the casing/liner wherein the expansion modules are arranged to be moved relative to each other in the axial direction of the casing/liner.

The piston(s) may be arranged above and or below the expansion modules or are included in the expansion modules at any position within the extension of the expansion modules in the axial direction of the expansion module. The piston(s) may be provided with means for controlling the communication of fluid between adjacent annulus spaces. In one embodiment the piston may be arranged below the expansion modules, thereby applying a pulling force to the expansion modules. By pulling the expansion modules the inside pressure of the pipe to be expanded will help the expansion process by reducing the required differential pressure across the piston(s).

In one embodiment of the invention, the number of pistons correspond to the number of expansion modules. In one aspect of this embodiment one piston is connected to or made part of the expansion module, wherein each set comprising a piston with corresponding expansion module is operated separately from the other sets. Each set may be placed at a predetermined position in the casing/liner. In another aspect, a set is moved in the down hole direction of the casing/liner to be placed into the previous position of the set ahead moving in further in a down hole direction, thereby obtaining a sequential or gradual expansion of the casing/liner.

In another embodiment the expansion modules are releasably connected to each other, in an direct or indirect arrangement. In one aspect the expansion modules are positioned over and below the piston in the well bore direction. Each expansion module is then to be moved by the piston to predetermined positions for the expansion to take place using the releasable connections to connect and disconnect the expansion module at the actual location.

Each of the expansion modules belonging to the same down hole well tool may have the same shape or may be shaped differently. In one aspect the cross sections of at least one of the expansion modules decreases in the axial direction of the tool unit. The expansion module may take on the shape of a truncated cone.

The size of the cross sections may vary from one expansion module to the other, for instance so that the cross section of the expansion modules are reduced when moving in the down hole direction of the down hole well tool.

Further, at least one of the expansion modules may be provided with rolling means at its outer periphery either along its entire axial direction or alternatively in portions of its axial direction, leaving some portions with no rolling means. In one aspect the expansion module is arranged with at least two sets of rolling means along the axial direction of the expansion module. The diameter of the rolling means decreases along the expansion module in the axial down hole direction of the well bore providing the expansion module with an decreasing diameter. The roller means may be constituted by rollers, balls or any other means capable of providing a rolling movement for the expansions module.

The invention also includes a method for installing a casing/liner in a well bore using a tool unit comprising at least one first fluid conduit and a return fluid conduit in use forming an annulus between the tool unit and the casing/liner. The tool unit comprises at least one piston in the annulus dividing the annulus into annulus spaces, wherein at least two expansion modules for the expansion of the casing/liner are positioned displaced in the axial direction of the casing/liner and are arranged to be moved relative to each other. The method comprises the steps of establishing a pressure difference over the at least one pistons for setting each of the expansion modules for the expansion of the casing/liner.

In some embodiments means for controlling the communication of fluid provided in the piston(s) is used to distribute fluid from one annular space to another.

In one embodiment each of the expansion modules is to be installed in the casing/liner to be positioned at predetermined locations.

The expansion of at least a portion of the casing/liner may occur sequentially, preferably by providing an initial expansion by one of the expansion modules, thereafter positioning another of the expansion modules at the location of the initial expansion for further expansion of the casing/liner element repeating this sequence until the achieving the predetermined expansion.

A casing/liner element may be installed at the end portion of the casing/liner in a position overlapping between the casing/liner element and the end portion of the casing/liner.

A drilling tool included at the end of the tool unit provides anchorage for the casing/liner in the well bore. A casing/liner element may be positioned to be installed at the end of an installed casing/liner element by the use of the tool unit.

BRIEF DESCRIPTION OF THE DRAWINGS

An example of embodiments of the invention is illustrated in the attached figures and is to be described in following with reference to the attached drawings, where.

DETAILED DESCRIPTION

Figure 1:
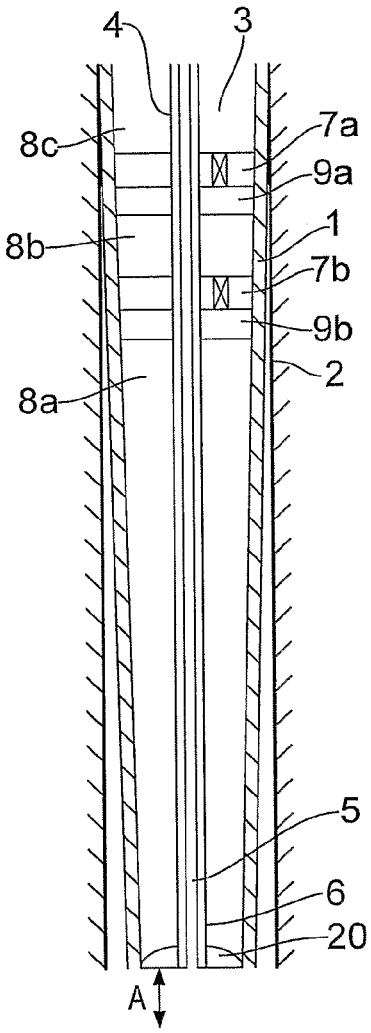
FIG. 1 shows a first embodiment of a down hole well tool.

FIG. 1 shows an embodiment of a down hole well tool 3 for the expansion of a casing/liner 1 in a well bore 2. The down hole well tool 3 comprises a tool unit 4 which is made up by at least one first fluid conduit 6 and a return fluid conduit 5 arranged inside the first fluid conduit 6. When placing the tool unit 4 in the casing/liner to be set in the well bore 2 an annulus appear between the tool unit 4 and the casing/liner 1.

In the shown embodiment the two pistons 7*a*, 7*b* are arranged in the annulus in between the tool unit 4 and the casing/liner 1 dividing the annulus into annulus spaces 8*a*, 8*b*, 8*c*. The features of the pistons 7*a*, 7*b* ensure that the two annulus spaces are isolated from each other, to prevent accidental fluid entry in between the annulus spaces, for instance by providing adequate sealing means in between the various parts of the tool unit 4. The two pistons 7*a*, 7*b* are each arranged to operate an expansion module 9*a*, 9*b* for displacing the expansion modules 9*a*, 9*b* in the axial direction A of the casing/liner to expand the casing/liner in the radial direction of the casing/liner. The pistons 7*a*, 7*b* with the belonging expansion modules 9*a*, 9*b* may each conduct the total expansion necessary at the location wherein placed or the expansion may occur sequentially. The sequential expansion procedure is to be carried out by an initial expansion using a first expansion module 9*a*, thereafter positioning another of the expansion modules at the location of the initial expansion for further expansion of the casing/liner element repeating this sequence until the achieving the total expansion necessary.

The pistons 7*a*, 7*b* are arranged above the expansion modules 9*a*, 9*b* in the well bore 2, but may of course also be positioned below the expansion module for moving the expansion module in the casing/liner. In the embodiment shown in FIG. 1, two sets, each comprising a piston and an expansion module, is shown arranged in the casing/liner. The number of sets necessary to expand the casing/liner is determined by the skilled person and may be chosen in accordance with the field of use. In this embodiment of the invention the expansion module 9*a*, 9*b* may be fixed to the pistons 7*a*, 7*b* or may be integrated as a part of the piston. A drill tool 20 may be used for providing anchorage for the casing/liner 1 when carrying out the expansion of the casing/liner.

Each of the sets of the shown embodiment comprising a piston 7*a*, 7*b* and an expansion module 9*a*, 9*b* is arranged to be operated separately. By the provision of a pressure difference in between the annulus spaces 8*b* and 8*c* at each side of the piston 7*a*, the piston 7*a* is able to move the expansion module 9*a* in the casing/liner 1 to carry out the expansion of the casing/liner 1. In the same way the expansion module 9*b* is operated to be moved in the casing/liner 1 by the differential pressure occurring over the piston 7*b* due to the pressure difference in between the annulus spaces 8*b* and 8*a*. The pistons 7*a*, 7*b* are provided by means for communication of fluid in between the annulus spaces 8*a*, 8*b*, 8*c* to be able to transfer fluid from one side of the piston to the other in order to control the movement of the piston and the expansion module.

Figure 2:
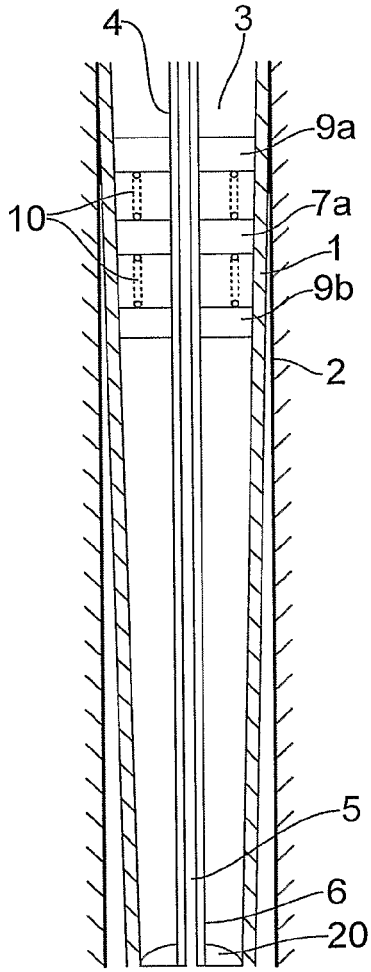
FIG. 2 shows a second embodiment of a down hole well tool.

FIG. 2 shows an embodiment of the down hole well tool 3 wherein a piston 7*a* is arranged to move two expansion modules 9*a*, 9*b* in the casing/liner 1 to the requested locations for expansion. In one aspect of the shown embodiment the piston 7*a* moves the expansion modules 9*a*, 9*b* into the requested locations in one operation. In another aspect the expansion modules 9*a*, 9*b* are releasably connected to the piston 7*a* by suitable connecting means 10. The piston 7*a* only connected to the expansion module 9*b* is then first moved to its requested location, whereupon the expansion module 9*b* is released from the piston 7*a* and the piston 7*a* returns to bring the expansion module 9*a* to its requested location. The piston 7*a* connects to the expansion module 9*a* and moves the expansion module 9*a* to its requested location.

The cross section of each of the expansion modules may vary in the axial direction of the tool unit and the expansion module may for instance assume the shape of a truncated cone.

Figure 3:
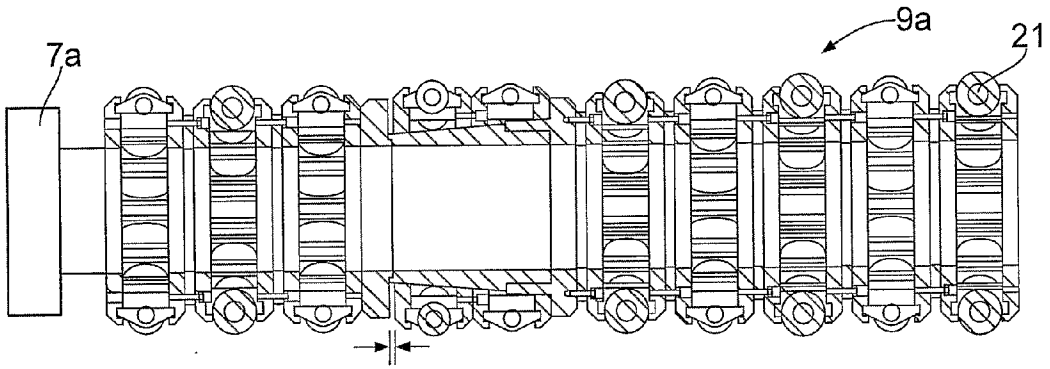
FIG. 3 shows an aspect of the first embodiment of a down hole well tool.

In FIG. 3 the expansion module 9*a* is shown with a conical shape and is arranged with several sets of rolling means 21 arranged at an outer surface of the expansion module 9*a* around the circumference of the expansion module, making up the expanding tool to engage the inner surface of the casing/liner 1. The rolling means have a rolling direction in the axial direction of the well bore 2. The diameter of the rolling means belonging to each set of rolling means decreases from one set to another. A reduction of the diameter of the expansion module 9*a* may be achieved as shown in FIG. 1 with each set having a reduced diameter compared to the next one in the down hole direction of the well bore. The expansion module 9*a* may be provided solely by having sets of rolling means along its length, or it may have portions with no rolling means. The piston(s) for driving the expansion module 9*a* is shown provided at the end of the expansion module 9*a* or may be placed at a middle portion of the expansion module 9*a*. Each of the pistons 7*a*, 7*b* and expansion modules 9*a*, 9*b*, as shown in FIG. 1, may be provided as shown in FIG. 3.

Figure 4:
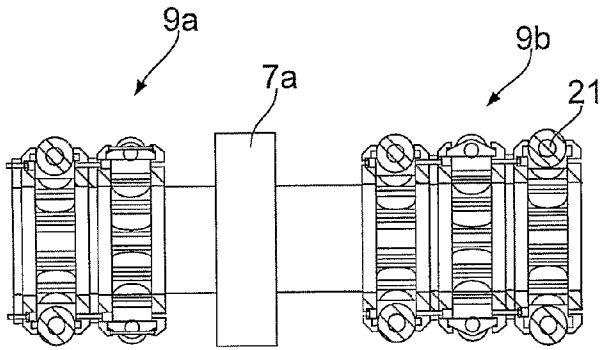
FIG. 4 shows an aspect of the second embodiment of a down hole well.

Further the piston 7*a* and the two releasably connected expansion modules 9*a*, 9*b* as shown in FIG. 2 may be arranged with rolling means 21 as shown in FIG. 4.

The invention claimed is:

1. A down hole well tool for installing a casing/liner in a well bore, wherein the down hole well tool comprises:

a tool unit comprising at least one first fluid conduit and a return fluid conduit, wherein in use an annulus is formed between the tool unit and the casing/liner, wherein the tool unit further comprises at least one piston in the annulus dividing the annulus into annulus spaces, wherein the tool unit is operated by differential fluid pressure brought about over the at least one piston; and at least two expansion modules for the expansion of the casing/liner positioned displaced in an axial direction of the casing/liner, wherein the movement of the at least one piston causes the movement of the expansion modules, wherein the expansion modules are arranged to be moved relative to each other in the axial direction of the casing/liner.

2. The down hole well tool of claim 1, wherein the size of the cross section of the down hole well tool varies in between the expansion modules.

3. The down hole well tool of claim 1, wherein the number of pistons correspond to the number of expansion modules.

4. The down hole well tool of claim 1, wherein at least one of the expansion modules is made part of one of the pistons.

5. The down hole well tool of claim 1, wherein the expansion modules are releasably connected to each other.

6. The down hole well tool of claim 1, wherein at least one of the expansion modules is provided with rolling means at its outer periphery.

7. The down hole well tool of claim 1, wherein the at least one piston is arranged above the expansion modules in the well bore.

8. The down hole well tool of claim 1, wherein a drilling tool included at an end of the tool unit provides anchorage for the casing/liner in the well bore.

9. The down hole well tool of claim 1, wherein the cross section of at least one of the expansion modules decreases in a down hole axial direction of the tool unit, forming a truncated cone.

10. The down hole well tool of claim 1, wherein each piston is provided with means for controlling the communication of fluid between adjacent annulus spaces.

11. The down hole well tool of claim 1, wherein the at least one piston is arranged below the expansion modules in the well bore.

12. A method for installing a casing/liner in a well bore, comprising:

positioning a tool unit comprising at least one fluid conduit and a return fluid conduit in the casing/liner such that an annulus is formed between the tool unit and the casing/liner, wherein the tool unit further comprises at least one piston in the annulus dividing the annulus into annulus spaces;

positioning displaced in an axial direction of the casing/liner at least two expansion modules for the expansion of the casing/liner, wherein the expansion modules are arranged to be moved relative to each other in the axial direction of the casing/liner; and establishing a pressure difference over the at least one piston for setting each of the expansion modules for the expansion of the casing/liner.

13. The method of claim 12, further comprising distributing fluid from one annulus space to another by means for controlling the communication of fluid provided in the at least one piston.

14. The method of claim 12, wherein the expansion of at least a portion of the casing/liner occurs sequentially.

15. The method of claim 14, wherein the expansion of at least a portion of the casing/liner occurs sequentially by providing an initial expansion by one of the expansion modules, thereafter positioning another of the expansion modules at the location of the initial expansion for further expansion of the casing/liner, and repeating this sequence until achieving the predetermined expansion.

16. The method of claim 12, further comprising installing a casing/liner element at an end portion of the casing/liner in a position overlapping between the casing/liner element and the end portion of the casing/liner.

17. The method of claim 12, further comprising positioning each of the expansion modules at predetermined locations in the casing/liner.

18. The method of claim 17, further comprising positioning a casing/liner element to be installed at the end of an installed casing/liner element by the use of the tool unit.

* * * * *